US011745217B2

(12) United States Patent
Oldorff

(10) Patent No.: US 11,745,217 B2
(45) Date of Patent: Sep. 5, 2023

(54) METHOD FOR FINISHING A WOOD BOARD

(71) Applicant: FLOORING TECHNOLOGIES LTD., Ricasoli (MT)

(72) Inventor: Frank Oldorff, Schwerin (DE)

(73) Assignee: FLOORING TECHNOLOGIES LTD, Kalkara (MT)

( * ) Notice: Subject to any disclaimer, the term of this patent is extended or adjusted under 35 U.S.C. 154(b) by 3 days.

(21) Appl. No.: 17/206,818

(22) Filed: Mar. 19, 2021

(65) Prior Publication Data

US 2021/0205842 A1 Jul. 8, 2021

Related U.S. Application Data

(63) Continuation of application No. 15/302,818, filed as application No. PCT/EP2015/001221 on Jun. 17, 2015, now Pat. No. 11,059,071.

(30) Foreign Application Priority Data

Jun. 24, 2014 (EP) ..... 14002166

(51) Int. Cl.
*B05D 5/06* (2006.01)
*B44C 5/04* (2006.01)
(Continued)

(52) U.S. Cl.
CPC ..... *B05D 5/06* (2013.01); *B05D 1/02* (2013.01); *B05D 1/265* (2013.01); *B05D 3/0254* (2013.01);
(Continued)

(58) Field of Classification Search
None
See application file for complete search history.

(56) References Cited

U.S. PATENT DOCUMENTS 6,021,615 A 2/2000 Brown
6,620,511 B1 * 9/2003 Wigger ..... C08G 18/0823 427/386
(Continued)

FOREIGN PATENT DOCUMENTS

CN 201292641 8/2009
CN 102277945 12/2011
(Continued)

OTHER PUBLICATIONS

Chinese Search Report in related CN application No. 201580033833.0 dated Oct. 25, 2017, 1 page.
(Continued)

*Primary Examiner* — James M Mellott
(74) *Attorney, Agent, or Firm* — Andrew M. Calderon; Calderon Safran & Cole P.C.

(57) ABSTRACT

The disclosure relates to a method for finishing a wood board with an upper face and a lower face, having the following steps: a) applying a undercoat made of a liquid melamine resin onto the upper face, the melamine resin at least partly penetrating into the upper edge layer of the wood board, b) drying the undercoat into an undercoat layer, c) applying a base color onto the undercoat layer, d) drying the base color into a base color layer, e) applying a base color onto the base color layer in order to produce a decorative element, f) drying the decorative element into a decorative layer, g) applying a liquid melamine resin onto the dried decorative layer, h) drying the melamine resin into a melamine resin layer, and i) applying a liquid medium with a proportion of isocyanate.

17 Claims, 1 Drawing Sheet

(51) Int. Cl.

| | |
|---|---|
| ***B05D 1/02*** | (2006.01) |
| ***B05D 1/26*** | (2006.01) |
| ***B05D 3/02*** | (2006.01) |
| ***B05D 3/12*** | (2006.01) |
| ***B05D 7/08*** | (2006.01) |
| ***B05D 7/00*** | (2006.01) |

(52) U.S. Cl.

CPC ..... *B05D 3/12* (2013.01); *B05D 7/08* (2013.01); *B05D 7/584* (2013.01); *B44C 5/04* (2013.01); *B44C 5/0476* (2013.01)

(56) References Cited

U.S. PATENT DOCUMENTS

| | | | | |
|---|---|---|---|---|
| 8,512,804 | B2 | 8/2013 | Oldorff | |
| 11,059,071 | B2 * | 7/2021 | Oldorff | B05D 7/08 |
| 2004/0006944 | A1 * | 1/2004 | Miyamoto | E04F 15/14 52/506.01 |
| 2009/0050054 | A1 * | 2/2009 | Oldorff | B05C 1/0813 118/200 |
| 2011/0217463 | A1 * | 9/2011 | Oldorff | B05C 9/04 427/209 |
| 2011/0268933 | A1 | 11/2011 | Hahn et al. | |
| 2013/0177742 | A1 * | 7/2013 | Siebert | B44C 5/043 428/165 |
| 2015/0152651 | A1 | 6/2015 | Siebert et al. | |

FOREIGN PATENT DOCUMENTS

| | | | |
|---|---|---|---|
| CN | 102400537 | 4/2012 | |
| EP | 1262607 | 9/2004 | |
| EP | 2338693 | 6/2011 | |
| WO | 9733930 | 9/1997 | |
| WO | 2012037950 | 3/2012 | |
| WO | WO-2012037950 A1 * | 3/2012 | E04F 15/107 |

OTHER PUBLICATIONS

Notice of Allowance in the related U.S. Appl. No. 15/302,818 dated Mar. 31, 2021, 6 pages.

* cited by examiner

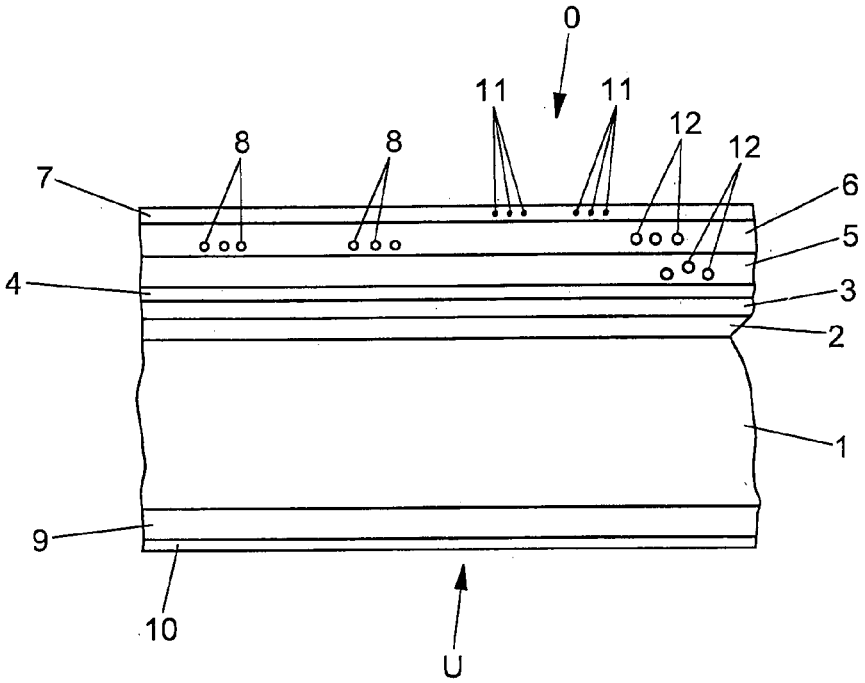
0
11
11
12
12
8
8
7
6
5
4
3
2
1
9
10
U

METHOD FOR FINISHING A WOOD BOARD

FIELD OF THE INVENTION

The invention relates to a process for the finishing of a wood-based board with an upper side and an underside.

DISCUSSION OF BACKGROUND INFORMATION

This type of process is known by way of example from EP 2 338 693 B1.

Wooden boards of this type, preferably composed of MDF or HDF, are widely used in many different sectors. One particularly large application sector is use as floor panel. In particular during this use, the wooden boards provided with the decorative effect are exposed to very high loading, in particular due to pedestrian traffic. In order to withstand these loadings, the decorative layer has to be covered by a protective layer. This is mostly composed of a synthetic resin, for example melamine resin, to which various additional substances have been admixed. The various layers applied to the wooden board give rise to tensile stresses, which can cause distortion of the wooden board. Another term used is bowing. It is therefore necessary to coat not only the upper side but also the underside of the wooden board, so that these forces arise to an equal extent on both sides, and therefore bowing is avoided.

There are very many different methods of applying the synthetic resin layer to the wooden board. By way of example, it is known that synthetic resin in the form of granulate or powder can be applied to that side of the wooden board that requires coating, and that any additional substances that may be provided can be scattered into the material. During the final pressing process, with exposure to pressure and heat, the applied powder melts and forms a homogeneous layer. This process naturally cannot coat both sides of the wooden board, because the scattered powder merely lies on the surface of the wooden board, and does not become bonded thereto until the pressing process takes place.

WO 2012/037950 A1 discloses provision of a substrate board in press-finished condition made of wood fibers or wooden chips, and application of a basecoat made of a liquid melamine resin to the upper side thereof, where the resin penetrates at least to some extent into the upper peripheral layer of the substrate board and at least to some extent penetrates into, and improves the quality of, the region of the press skin that arose during production of the wooden board. After drying of the basecoat, a primer is applied, and then a water-based coating material is used to print a decorative effect onto the dried primer layer. A protective covering layer made of at least one melamine resin enriched with abrasion-resistant particles and with cellulose fibers is then applied to the decorative effect. A basecoat made of a liquid melamine resin is likewise applied to the underside of the substrate board, and penetrates into the lower peripheral layer of the substrate board. A counterbalancing material is then applied to the said basecoat on the underside of the substrate board, and the layer structure is pressed with exposure to pressure and heat. By virtue of said basecoat which penetrates into the press skin, it is no longer necessary to grind the upper side and underside of the substrate board before it is subjected to further operations. It is thus possible to manufacture the substrate board with lower thickness, with resultant reduced production costs. The penetration of resin into the substrate board moreover firstly compensates the properties of the press skin and secondly also provides a good basis for the decorative effect and an abrasion-resistant layer.

The wooden boards produced by this process have a very hard surface. Because of the hard surface, when floor panels are produced from this type of wood-based board, the level of impact sound resulting from pedestrian traffic on the floor is relatively high, and the resultant noise level is perceived as unacceptable. The hardness of the surface moreover makes it relatively brittle, and microcracks can therefore form when heavy objects fall onto the floor from a great height.

EP 1 262 607 B1 discloses that impact sound generation can be reduced in the case of laminate floor panels by applying, to the reverse side of the decorative layer, a polyurethane layer which is pressed with the decorative layer, and with a wear-protection layer applied to the decorative layer, to give a sandwich. This sandwich is then laminated to a substrate board made of wood or wood-derived material, in particular MDF or HDF. The polyurethane layer on the reverse side of the decorative layer can be applied directly as a two-component polyurethane coating by doctoring or spreading onto the decorative layer. Polyurethane has the particular advantage that its characteristic properties can be adjusted over a wide range. This in particular applies to hardness, resilience, impression behavior, and recovery from impressions due to pedestrian traffic. However, polyurethane also has the disadvantage of being more expensive than melamine resin, for example by a factor from 10 to 15.

Production of this type of large-format substrate board is moreover very complicated, and can be achieved industrially only at very high cost. Floor panels produced by said process are very expensive because of the complicated technology used, and this product cannot therefore meet the large requirement that exists for laminates with a coating that is warmer and softer, and that produces less noise.

SUMMARY OF THE INVENTION

On the basis of these problems, the invention is based on the object of improving the manufacturing technology known per se for lamination based on melamine resin in a manner that allows easy and reliable production of laminates with a coating that is warmer and softer, and that produces less noise, and that moreover allows easy integration of the technology into existing manufacturing procedures. The intention here is that there be, of course, no impairment of behavior in relation to mechanical stress, such as impact or abrasion, but instead where possible actually improvement of said behavior.

The relevant process for solving the problems features the following steps:

a) application of a basecoat made of a liquid melamine resin to the upper side, where the melamine resin penetrates at least to some extent into the upper peripheral layer of the wood-based board, b) drying of the basecoat to give a basecoat layer, c) application of a base color to the basecoat layer, d) drying of the base color to give a base color layer, e) application of a printing ink to the base color layer to produce a decorative effect, f) drying of the decorative effect to give a decorative layer, g) application of a liquid melamine resin to the dried decorative layer, h) drying of the melamine resin to give a melamine resin layer, i) application of a liquid medium having a proportion of isocyanate groups to the melamine resin layer.

Isocyanate groups are highly reactive. They react with the NH group or the methylol group of the melamine resin, and this leads to particularly effective anchoring of the resulting layer of the liquid medium on the surface of the melamine resin layer. After the subsequent pressing process of the layer structure with the wood-based board, this leads to a coating which has warmer and softer haptic properties than a melamine resin layer. If floor panels are then produced from the wood-based board, this leads, in the case of laminate flooring, to reduced room noise. Numerous experiments have shown that there is no impairment of behavior in relation to mechanical stress such as impact or abrasion in comparison with conventional coatings.

It is preferable that liquid melamine resin is also applied to the underside of the substrate board and dried to give a counterbalancing material. This can prevent distortion of the board or of the panels produced from the board. A liquid medium having a proportion of isocyanate groups can also be applied to the counterbalancing material.

The medium can be a dispersion which has from 50 to 60% solids content, the remainder being water as solvent, and which is dried after application to give a layer.

Other materials that can also be used, alongside water, are organic solvents or additions, for example dispersing agents, release agents, wetting agents, or antifoams. It is also possible that the medium is a molten hotmelt which has 100% solids content (hotmelt adhesive), which solidifies on cooling after application to give a layer. Formation of the layer can be accelerated by active cooling.

Hotmelt is applied either by using a slot die or by spray application.

It is preferable that at least one protective covering layer composed of a UV lacquer is applied to the dried/solidified layer of medium. It is preferable that the protective covering layer comprises nanoparticles in order to improve resistance to microscratching.

In order to increase the abrasion resistance of the board, there are preferably wear-inhibiting particles, in particular corundum particles, these being present in the liquid medium and/or being sprayed onto the liquid medium, preferably before it forms a layer.

The melamine resin layer and/or the protective covering layer can comprise glass beads and/or agents having antistatic and/or antibacterial effect. The glass beads in the form of microglass material with diameter below 30 μm can serve to improve surface properties in particular in the melamine resin layer, and/or in the form of glass beads with diameter from 30 to 120 μm can serve as spacers between the press plate and the layer comprising the wear-inhibiting particles, with resultant reduced wear on the press plate.

The medium can be applied in a plurality of individual layers. It is preferable that the quantity of the medium applied is from 50 to 200 g/m$^2$.

During the pressing process of the layer structure, it is possible that a structure is embossed at the upper side of the final layer, and with particular preference is formed synchronously with respect to the decorative effect ("synchronous pores"). The decorative effect here can be a decorative wood effect, decorative stone effect, or decorative tile effect, or else an imaginative decorative effect.

If a dispersion is used as medium, it is preferable that a short-cycle press is used for the pressing process of the layer structure. If a hotmelt is used as medium, it is preferable that a structured roll (calender roll) is used for the pressing process.

The melamine resin can be pure melamine resin. However, it is preferable that it is a mixture of melamine resin and urea resin.

BRIEF DESCRIPTION OF THE DRAWINGS

The invention will be described in more detail below with the aid of a drawing.

The single FIGURE shows a wood-based board of the invention.

DETAILED DESCRIPTION OF THE PRESENT INVENTION

The single FIGURE shows a wood-based board 1 made of HDF or MDF with an upper side O and an underside U. Liquid melamine resin is applied as basecoat to the upper side O, and penetrates at least to some extent into the upper peripheral layer of the wood-based board 1. The basecoat is then dried to give a basecoat layer 2. A base color is applied to the dried basecoat layer 2, and is dried to give a base color layer 3. A printing ink is applied to the base color layer 3 to produce a decorative effect, and said ink is then dried to give a decorative layer 4. A liquid melamine resin is applied to the dried decorative layer 4, and is dried to give a melamine resin layer 5. The melamine resin can comprise glass beads 12, in particular with diameter up to 30 μm, these being mixed into the liquid melamine resin.

A liquid medium which comprises a proportion of isocyanate groups is applied to the upper side O of the melamine resin layer 5. The liquid medium preferably has from 50 to 60% solids content, with water as solvent. Other materials that can also be used alongside water are organic solvents or additions, for example dispersing agents, release agents, wetting agents, and/or antifoams. Drying of the liquid medium then forms a layer.

It is also possible, instead of application of the liquid medium in the form of dispersion to the upper side O of the melamine resin layer 5, followed by active drying, to use a hotmelt (hotmelt adhesive) which has isocyanate groups. The hotmelt is heated before application and then, on cooling, spontaneously forms the layer 6. Formation of the layer can be accelerated by active cooling.

Hotmelt used can by way of example be the product marketed as PUR HC 717.5 from Kleiberit. The isocyanate groups in the hotmelt or in the (dried) dispersion are reactive, and react with the methylol group of the melamine resin to give a polyurethane, and/or with the NH group to give a urea derivative. Another possibility is the reaction with water to give amine and further reaction with free isocyanate groups to give urea derivatives. This achieves anchoring of the dried dispersion or of the hotmelt on the melamine resin layer 5. A layer is thus formed which, in comparison with a pure melamine resin layer, is softer, but nevertheless more wear-resistant, has warmer haptic properties, and produces less noise.

The medium 6 can comprise wear-inhibiting particles 8, in particular corundum particles, which can be mixed into the medium and/or scattered thereon, and also glass beads 12 with diameter from 30 to 120 μm which, during the subsequent pressing process, serve as spacers between the press plate and the wear-inhibiting particles 8, in order to reduce wear on the press plate.

A protective covering layer 7 is applied to the upper side O of the solid layer 6 of medium, and can be composed of a UV lacquer which preferably comprises nanoparticles 11 based on silica in order to increase resistance to microscratching.

The protective covering layer 7 can moreover comprise agents having antistatic and/or antibacterial effect. There can also be microglass material 12 with diameter up to 30 μm provided to improve surface properties.

The resultant layer structure is finally—as is known—pressed with exposure to pressure and heat to give a laminate. It is possible here that a structure corresponding to the decorative effect is embossed into the layer structure, in particular into the layer 6. If a dispersion is applied as liquid medium, it is preferable that a short-cycle press is used for the pressing process of the layer structure. If a hotmelt is used, it is preferable that a calender roll is used to press the layer structure. In the case of the short-cycle press, the structure has been engraved into the press plate, and in the case of the calender roll, it has been engraved into the circumferential surface thereof.

The invention claimed is:

1. A process for finishing of a wood-based board with an upper side and an underside, comprising:

a) application of a basecoat made of a first liquid melamine resin to the upper side of the wood-based board, wherein the first liquid melamine resin penetrates at least to some extent into the upper side of the wood-based board, b) drying the basecoat to give a basecoat layer, c) application of a base color to the basecoat layer, d) drying the base color to give a base color layer, e) application of at least one printing ink to the base color layer to produce a decorative effect, wherein the decorative effect is based on the base color and the at least one printing ink, f) drying the at least one printing ink to give a decorative layer, g) application of a second liquid melamine resin to the decorative layer, h) drying the second liquid melamine resin to give a melamine resin layer, i) application of a liquid medium having a proportion of isocyanate groups to the melamine resin layer in a quantity from 50 to 200 g/m$^2$, wherein the liquid medium is a dispersion which has a solid content and water as a solvent, wherein the liquid medium is applied in a plurality of individual layers, j) drying the liquid medium with a proportion of isocyanate groups to give a finished layer, and k) pressing layers under pressure and heat to form the finished wood-based board, wherein the isocyanate groups are reactive, and react with an NH group or a methylol group of the melamine resin layer when the liquid medium is applied to the melamine resin layer, leading to anchoring of the resulting layer of the liquid medium on the surface of the melamine resin layer;

wherein a third liquid melamine resin is applied to the underside, and is dried to provide a counterbalancing material.

2. The process as claimed in claim 1, wherein the liquid medium having the proportion of isocyanate groups is applied to the counterbalancing material.

3. The process as claimed in claim 1, wherein the liquid medium includes the water, in addition to organic solvents or additions.

4. The process as claimed in claim 3, wherein the organic solvents or additions are dispersing agents, release agents, wetting agents, and/or antifoams.

5. The process as claimed in claim 1, wherein at least one protective covering layer is applied to a dried layer of the liquid medium.

6. The process as claimed in claim 5, wherein the at least one protective covering layer comprises nanoparticles in order to improve resistance to microscratching.

7. The process as claimed in claim 1, wherein the liquid medium comprises wear-inhibiting particles.

8. The process as claimed in claim 7, wherein the wear-inhibiting particles are corundum particles.

9. The process as claimed in claim 1, wherein at least one of the liquid medium, the first and second melamine resin layers, and protective covering layer comprise(s) glass beads and/or agents having antistatic and/or antibacterial effect.

10. The process as claimed in claim 9, wherein a diameter of the glass beads is less than 30 μm.

11. The process as claimed in claim 9, wherein a diameter of the glass beads is from 30 to 120 μm.

12. The process as claimed in claim 1, wherein the liquid medium is applied in a plurality of individual layers.

13. The process as claimed in claim 1, wherein during the pressing of the layered structure a structure is embossed into the layers applied on the upper side.

14. The process as claimed in claim 13, wherein the structure is formed synchronously with respect to the decorative effect.

15. The process as claimed in claim 1, wherein a short-cycle press is used for a pressing process.

16. The process as claimed in claim 1, wherein the decorative effect is a decorative wood effect, decorative stone effect, decorative tile effect, or imaginative decorative effect.

17. The process as claimed in claim 1, wherein the isocyanate groups are in a dried dispersion of the liquid medium, wherein the reaction between the NH group of the melamine resin layer and the dried dispersion provides a polyurethane, and wherein the reaction between the methylol group of the melamine resin layer and the dried dispersion provides a urea derivatives.

* * * * *